US006296049B1

(12) United States Patent
Ozeki et al.

(10) Patent No.: US 6,296,049 B1
(45) Date of Patent: Oct. 2, 2001

(54) CONDENSER

(75) Inventors: Toshiaki Ozeki; Kenji Sato; Tadafumi Shintani, all of Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/546,655

(22) Filed: Apr. 10, 2000

(30) Foreign Application Priority Data

Apr. 15, 1999 (JP) ..... 11-108054

(51) Int. Cl.[7] ..... F28B 3/00
(52) U.S. Cl. ..... 165/114; 165/111
(58) Field of Search ..... 165/111, 112, 165/114

(56) References Cited

U.S. PATENT DOCUMENTS 3,520,521 * 7/1970 Heller et al. ..... 165/114
3,938,588 * 2/1976 Coit ..... 165/113
5,465,784 * 11/1995 Blangetti et al. ..... 165/114
6,041,852 * 3/2000 Sato et al. ..... 165/114

FOREIGN PATENT DOCUMENTS

19450-A1 * 7/1914 (GB) ..... 165/114
53-147103-A1 * 12/1978 (JP) ..... 165/114

* cited by examiner

*Primary Examiner*—Allen Flanigan
(74) *Attorney, Agent, or Firm*—Oblon, Spivak, McClelland, Maier & Neustadt, P.C.

(57) ABSTRACT

A condenser including a steam cooling tube bundle having a number of steam cooling tubes, an enclosure enclosing a central space formed at an inside of the steam cooling tube bundle, an air cooling tube bundle disposed in the enclosure and having a number of air cooling tubes, and a tube support plate supporting the steam cooling tube bundle. The steam cooling tube bundle includes upper and lower tube bundles. The enclosure includes a pair of enclosing bodies dividing the steam cooling tube bundle into two parts. Each of the enclosing bodies includes an upper enclosing plate having at least a sloping surface inclined downward to an outside from an inside of the enclosure and a bottom enclosing plate disposed downward of the upper enclosing plate. A flow opening is formed at a joined portion of upper and bottom enclosing plates to communicate the inner space and the outer space. A drain opening is formed at a joined portion of the bottom enclosing plate positioned at the inner space side and the tube support plate.

5 Claims, 6 Drawing Sheets

CONDENSER

BACKGROUND OF THE INVENTION

1. Field of the Invention

The present invention relates to a condenser for condensing exhaust steam from a steam turbine used in a thermal power plant or a nuclear power plant.

2. Description of the Related Art

A steam turbine used in a thermal power plant or a nuclear power plant sends the steam worked and expanded therein to a surface condenser. The exhaust steam flowing into this condenser is heat-exchanged with cooling water, such as seawater, river water, etc. in cooling tubes and condensed and collected.

FIG. 7 shows the schematic structure of a conventional condenser. In a condenser shell 1, two steam cooling tube bundles 2 of the same construction are disposed. Hereinafter, the description is made with respect to only one of steam cooling tube bundles 2, for the simplicity of the explanation. Steam cooling tube bundle 2 is composed of a number of steam cooling tubes 15 which are disposed in parallel with each other and extend horizontally. Steam cooling tube bundle 2 is divided into an upper tube bundle 2A and a lower tube bundle 2B. In a central space 16 formed between upper tube bundle 2A and lower tube bundle 2B, an enclosure 3 is disposed, in which an air cooling tube bundle 4 is disposed.

Air cooling tube bundle 4 is composed of a number of air cooling tubes 17 which are disposed in parallel with each other and extend in the extending direction of steam cooling tubes 15, and cools non-condensable gases, such as Air, Ammonia and the like which are contained in turbine exhaust steam or flow therein from other systems and parts. Further, at the lower part of condenser shell 1, a hot well 5 is disposed to collect and discharge drain (condensed water) condensed in steam cooling tube bundles 2 and air cooling tube bundles 4.

The turbine exhaust steam discharged from the steam turbine enters into condenser shell 1, and flows into steam cooling tube bundle 2 from the outer circumference of steam cooling tube bundle 2. Then the turbine exhaust steam is condensed on the surfaces of steam cooling tubes 15, while it flows toward air cooling tube bundle 4. The drain condensed in steam cooling tube bundle 2 drips into hot well 5.

The turbine exhaust steam contains Ammonia gas generated through decomposition of a corrosion inhibitor poured in boiler feed water. And therefore, with the condensation of the steam in steam cooling tube bundle 2, the concentration of Ammonia solved in the drain increases gradually. As partial pressure of steam drops on the surface of air cooling tubes 17 of air cooling tube bundle 4, steam is further condensed, and as a result, the drain (condensed water) of high Ammonia concentration is generated. The drain of high Ammonia concentration also drips into hot well 5 from air cooling tube bundle 4.

Further, Copper alloy is generally used for steam cooling tubes 15 of steam cooling tube bundle 2. This Copper alloy cooling tubes has the nature to be corroded severely with the drain (condensed water) of high Ammonia concentration. This phenomenon is called "Ammonia attack". Therefore, Titanium which has excellent corrosion resistance is generally used for air cooling tubes 17 of air cool tube bundle 4.

However, a conventional condenser has such a problem that steam cooling tubes 15 composing lower tube bundle 2B are corroded by the drain of high Ammonia concentration, because the drain of high Ammonia concentration condensed in air cooling tube bundle 4 drips into hot well 5 while contacting with steam cooling tubes 15 of lower tube bundle 2B. This kind of problem is also generated in a case where turbine exhaust steam contains corrosive gases other than Ammonia. Further, in many cases, with the progress of the condensation of steam, the corrosion is generated near support plates and tube plates where Ammonia of high concentration tends to be generated.

SUMMARY OF THE INVENTION

Accordingly, one object of the present invention is to provide a condenser that is capable of preventing the corrosion of steam cooling tubes by highly corrosive condensed water.

These and other objects of this invention can be achieved by providing a condenser including, a steam cooling tube bundle having a number of steam cooling tubes disposed in parallel with each other and extending horizontally, an enclosure enclosing a central space formed at a center portion in a vertical direction at an inside of the steam cooling tube bundle, an air cooling tube bundle disposed in the enclosure and having a number of air cooling tubes disposed in parallel with each other and extending along an extending direction of the steam cooling tube bundle, and a tube support plate supporting the steam cooling tube bundle. The steam cooling tube bundle includes an upper tube bundle positioned upward of the central space and a lower tube bundle positioned downward of the central space. The enclosure includes a pair of enclosing bodies disposed separately each other and symmetrically with respect to a vertical surface dividing the steam cooling tube bundle into two parts. Each of the enclosing bodies includes an upper enclosing plate having at least a sloping surface inclined downward to an outside from an inside of the enclosure and a bottom enclosing plate disposed downward of the upper enclosing plate. The bottom enclosing plate includes an outermost end extending outside from an outermost end of the upper enclosing plate, and further includes an outer dam part erected at the outermost end of the bottom enclosing plate. The bottom enclosing plate includes an innermost end extending inside from an innermost end of the upper enclosing plate, and further includes an inner dam part erected at the innermost end of the bottom enclosing plate. A lower end portion of the outermost end of the upper enclosing plate is joined to an upper surface of the bottom enclosing plate, thereby dividing an upper space of the upper enclosing plate into an inner space and an outer space. A flow opening is formed at a joined portion of the upper enclosing plate and the bottom enclosing plate to communicate the inner space and the outer space. And a drain opening is formed at a joined portion of the bottom enclosing plate positioned at the inner space side and the tube support plate.

According to one aspect of this invention, there is provided a condenser including, a steam cooling tube bundle having a number of steam cooling tubes disposed in parallel with each other and extending horizontally, an enclosure enclosing a central space formed at a center portion in a vertical direction at an inside of the steam cooling tube bundle, an air cooling tube bundle disposed in the enclosure and having a number of air cooling tubes disposed in parallel with each other and extending along an extending direction of the steam cooling tube bundle, and a tube support plate supporting the steam cooling tube bundle. The steam cooling tube bundle includes an upper tube bundle positioned upward of the central space and a lower tube bundle positioned downward of the central space. The enclosure includes a pair of enclosing bodies disposed separately each other and symmetrically with respect to a vertical surface dividing the steam cooling tube bundle into two parts. Each of the enclosing bodies includes an upper enclosing plate having at least a sloping surface inclined downward to an outside from an inside of the enclosure and a bottom enclosing plate disposed downward of the upper enclosing plate. The bottom enclosing plate includes an outermost end extending outside from an outermost end of the upper enclosing plate, and further includes an outer dam part erected at the outermost end of the bottom enclosing plate. The bottom enclosing plate includes an innermost end extending inside from an innermost end of the upper enclosing plate, and further includes an inner dam part erected at the innermost end of the bottom enclosing plate. A lower end portion of the outermost end of the upper enclosing plate is joined to an upper surface of the bottom enclosing plate, thereby dividing an upper space of the upper enclosing plate into an inner space and an outer space. An outer drain opening is formed at a joined portion of the bottom enclosing plate positioned at the outer space side and the tube support plate. And an inner drain opening is formed at a joined portion of the bottom enclosing plate positioned at the inner space side and the tube support plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
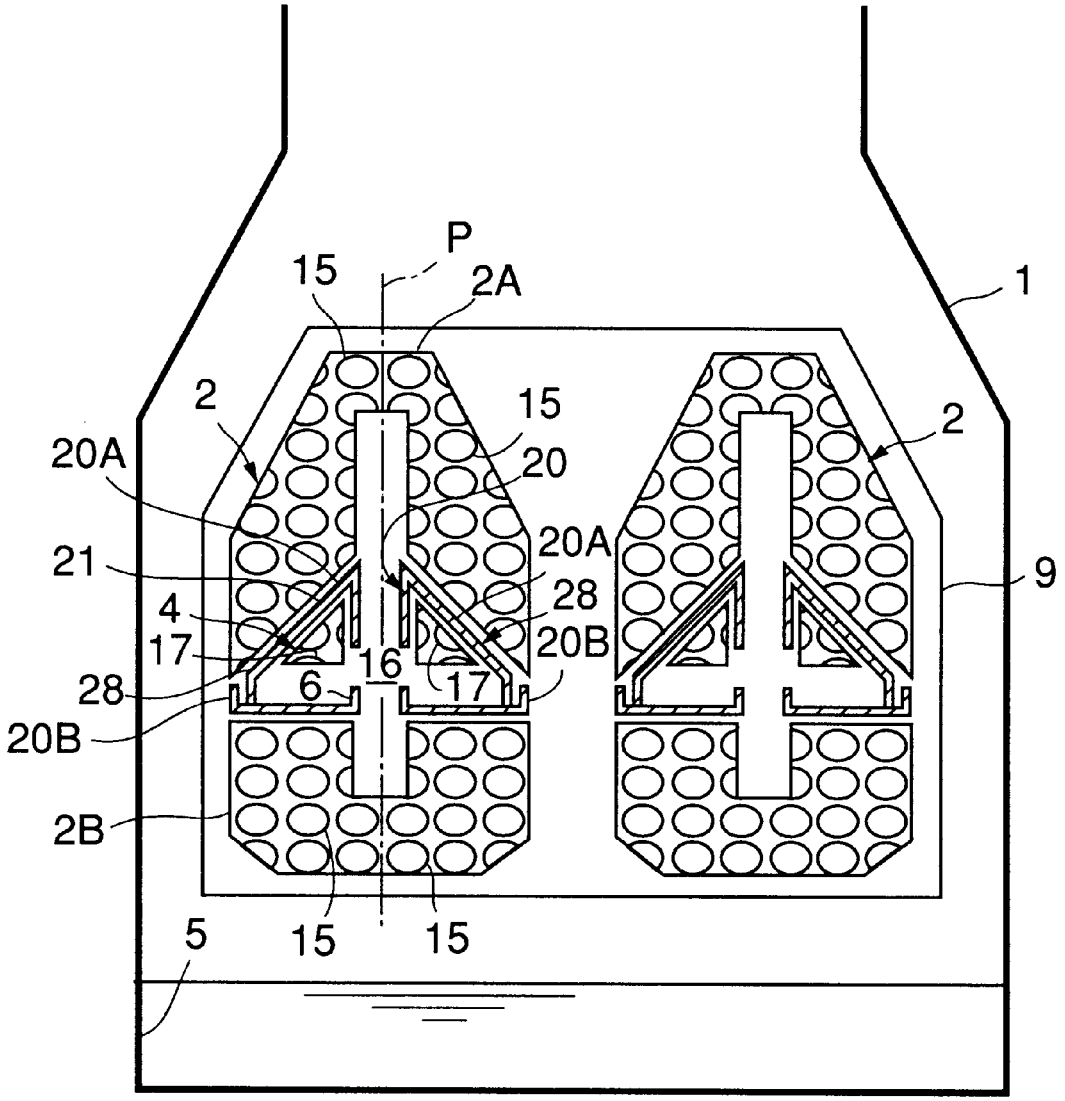
FIG. 1 is a cross sectional view showing the schematic structure of a condenser according to a first embodiment of the present invention.

Referring now to the drawings, wherein like reference numerals designate identical or corresponding parts throughout the several views, the embodiments of this invention will be described below.

First Embodiment

Figure 7:
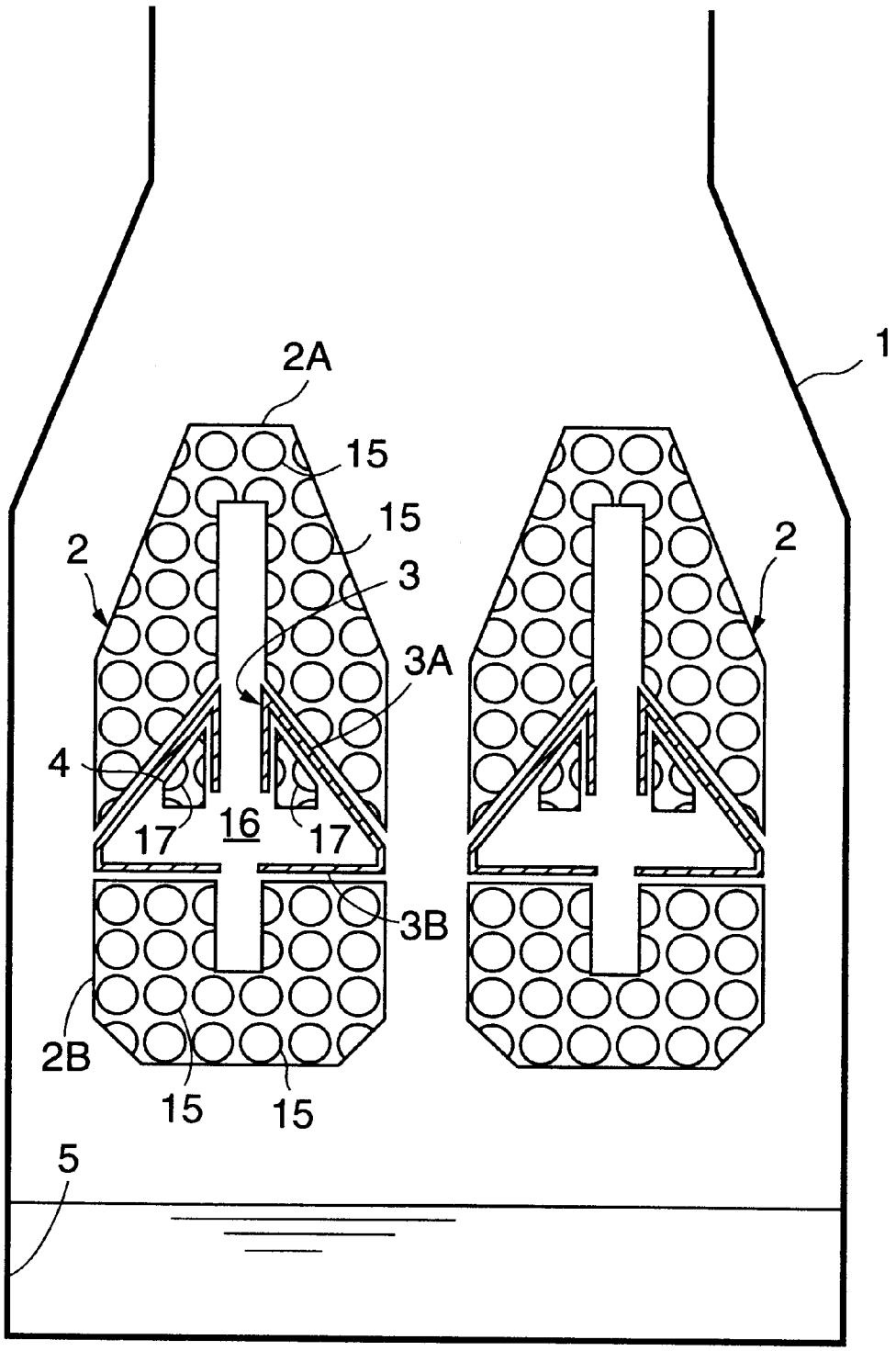
FIG.7 (PRIOR ART)
FIG. 7 is a cross sectional view showing the schematic structure of a conventional condenser.

A condenser according to a first embodiment of the present invention will be described below referring to FIGS. 1 and 2. Further, the same elements as those in the conventional condenser shown in FIG. 7 are explained by assigning the same reference numerals.

Figure 2:
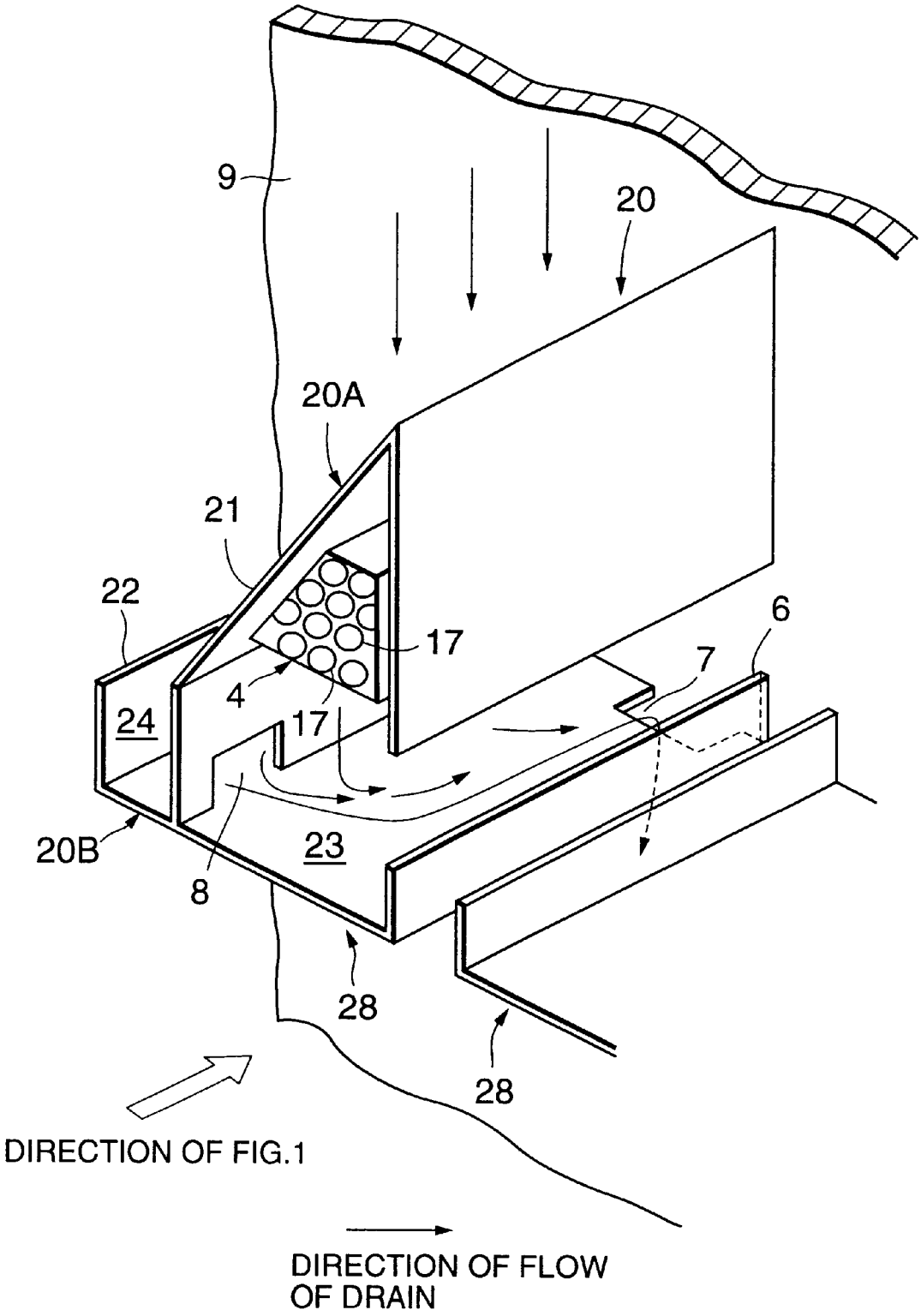
FIG. 2 is a perspective view showing enlargely an essential part of the condenser shown in FIG. 1.

FIG. 1 is a cross sectional view showing the schematic structure of a condenser according to this embodiment of the present invention, and FIG. 2 is a perspective view showing enlargedly an essential part of the condenser shown in FIG. 1. As shown in FIG. 1, two steam cooling tube bundles 2 with the same construction are disposed in condenser shell 1. Hereinafter, the description is made with respect to only one of steam cooling tube bundles 2, for the simplicity of the explanation. Steam cooling tube bundle 2 is composed of a number of steam cooling tubes 15 which are disposed in parallel with each other and extend in the horizontal direction.

Steam cooling tube bundle 2 is divided into upper tube bundle 2A and lower tube bundle 2B. In central space 16 formed between these upper and lower tube bundles 2A and 2B, an enclosure 20 is disposed. As shown in detail in FIG. 2, in enclosure 20, air cooling tube bundle 4 is provided. Air cooling tube bundle 4 is composed of a number of air cooling tubes 17 which are disposed in parallel with each other and extend in the extending direction of steam cooling tubes 15, and condenses the exhaust steam from the steam turbine and cools the non-condensable gases, such as Air, Ammonia, and the like.

Below condenser shell 1, there is disposed hot well 5 to collect and discharge the drain (condensed water) condensed in steam cooling tube bundle 2 and air cooling tube bundle 4.

Enclosure 20 is composed a pair of enclosing bodies 28 that are separated each other and disposed symmetrically with respect to a vertical surface P dividing steam cooling tube bundle 2 into two parts. Each enclosing body 28 is composed of an upper enclosing plate 20A and a bottom enclosing plate 20B. Upper enclosing plate 20A has a sloping surface 21 inclined downward from the inside of enclosure 20 to the outside. Bottom enclosing plate 20B is extended toward the outside from the most outer end of upper enclosing plate 20A, and its most outside part is bent upward, thereby making an outer dam part 22.

The lower end part of the most outer end of upper enclosing plate 20A is joined to the upper surface of bottom enclosing plate 20B by welding and the like, thereby dividing an upper space of bottom enclosing plate 20B into an inner space 23 and an outer space 24. At the joined part of upper enclosing plate 20A and bottom enclosing plate 20B, a flow opening 8 is formed to communicate inner space 23 and outer space 24.

Further, bottom enclosing plate 20B is extended toward the inside from the most inner end of upper enclosing plate 20A, and its most inner part is bent upward, thereby forming an inner dam part 6. On the upper surface of bottom enclosing plate 20B positioned at the lower end part of the most inner end of upper enclosing plate 20A, there is provided a space therebetween. At the connecting portion of bottom enclosing plate 20B positioned at inner space 23 side and a tube support plate 9, a drain opening 7 is formed to force the condensed water in inner space 23 to flow down along tube support plate 9.

Next, the operation of the condenser of this embodiment will be described. The exhaust steam discharged from the steam turbine enters into condenser shell 1, and flows into steam cooing tube bundle 2 from its outer circumference. Then the turbine exhaust steam is condensed on the surfaces of steam cooling tubes 15, while it flows toward air cooling tube bundle 4. As the turbine exhaust steam contains Ammonia gas, with the condensation of the steam on steam cooling tubes 15, the concentration of Ammonia increases gradually. Accordingly, the drain (condensed water) of low Ammonia concentration is generated in steam cooling tube bundle 2, and on the other hand, the drain (condensed water) of high Ammonia concentration is generated in air cooling tube bundle 4.

The drain of low Ammonia concentration generated in upper tube bundle 2A flows down along sloping surface 21 of upper enclosing plate 20A, and is caught by outer dam part 22 that is bent upward at the end of bottom enclosing plate 20B and accumulated in outer space 24. The drain of low Ammonia concentration accumulated in outer space 24 flows into inner space 23 through flow opening 8.

On the other hand, the drain of high Ammonia concentration condensed in air cooling tube bundle 4 drips on bottom enclosing plate 20B in inner space 23, and is diluted by the drain of low Ammonia concentration flowed into inner space 23 through flow opening 8. The diluted drain flows through drain opening 7 and flows down into hot well 5 along tube support plate 9.

As described above, according to the condenser of this embodiment, the drain of high Ammonia concentration condensed in air cooling tube bundle 4 flows into hot well 5 after diluted with the drain of low Ammonia concentration. Therefore, the corrosion of lower tube bundle 2B and tube support plate 9 by the Ammonia attack can be prevented.

Further, this condenser is provided with inner dam part 6, the drain is always accumulated in the inside of enclosure 20. Therefore, even when the steam pressure at around the outside of steam cooling tube bundle 2 is higher than the inner pressure in inner space 23 of enclosure 20, the steam does not flow into inner space 23 by passing through drain opening 7.

Further, the drain condensed in upper tube bundle 2A and air cooling tube bundle 4 flows into hot well 5 along tube support plate 9 through drain opening 7. Therefore, in lower tube bundle 2B, the drop of heat transfer on the tube surfaces caused by the liquid film formed on the tube surfaces can be prevented.

Second Embodiment

Next, a condenser according to a second embodiment of the present invention will be explained referring to FIG. 3. Further, this embodiment is partially modified from the first embodiment, and portions differing from the first embodiment will be explained below.

Figure 3:
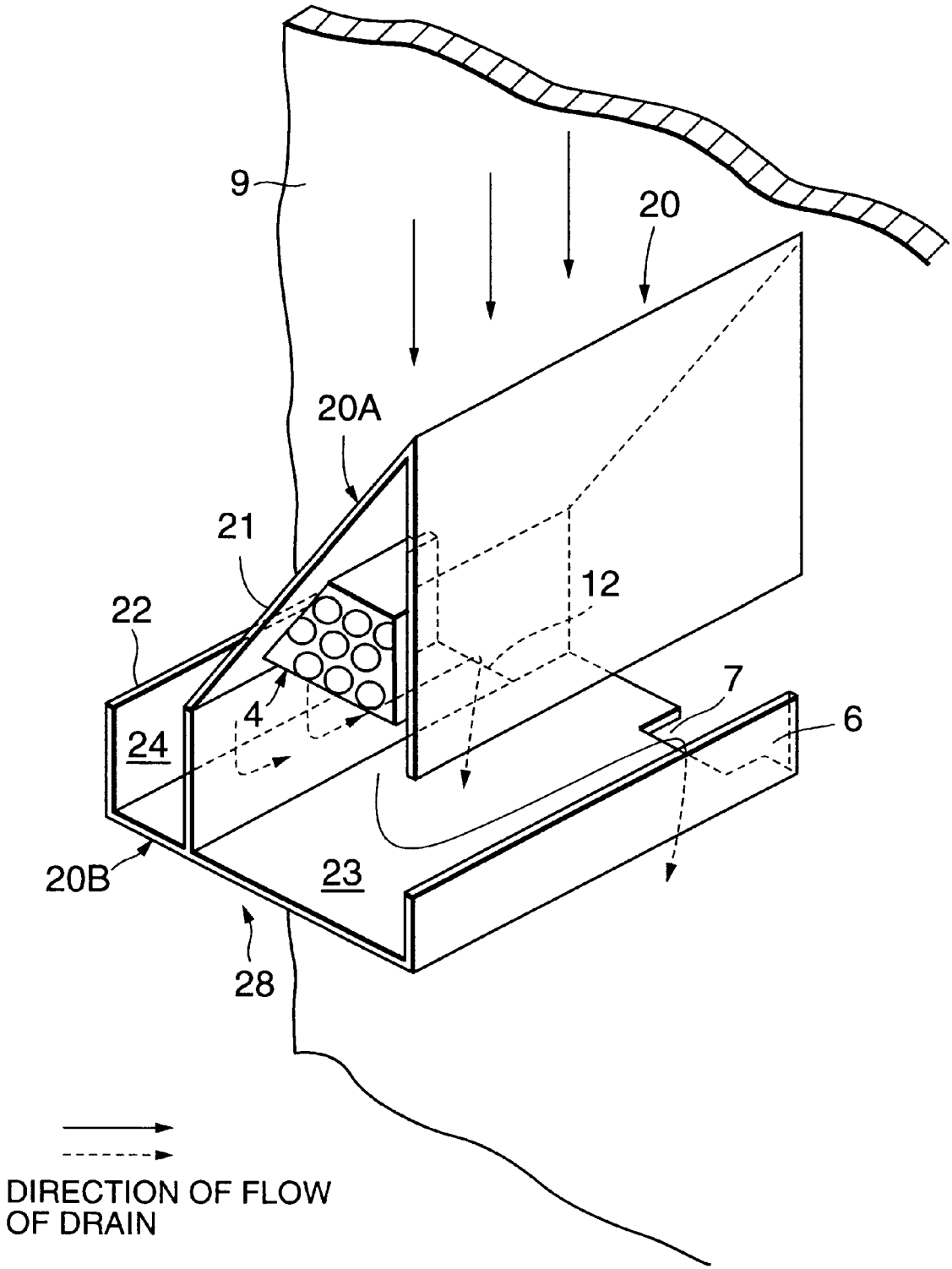
FIG. 3 is a perspective view showing an essential part of a condenser according to a second embodiment of the present invention.

FIG. 3 is a perspective view showing an essential part of a condenser according to this embodiment. As shown in FIG. 3, flow opening 8 in the first embodiment shown in FIG. 2 is not formed in this embodiment, and inner space 23 and outer space 24 are divided and intercepted by upper enclosing plate 20A.

In this embodiment, at the joined portion of bottom enclosing plate 20B positioned at outer space 24 side and tube support plate 9, an outer drain opening 12 is formed to force the drain (condensed water) accumulated in outer space 24 to flow down along tube support plate 9.

Further, the drain accumulated in inner space 23 is discharged through inner drain opening 7 likewise the first embodiment.

As described above, according to the condenser in this embodiment, the drains condensed in upper tube bundle 2A (refer to FIG. 1) and air cooling tube bundle 4 are respectively guided to flow down into hot well 5 along tube support plate 9 from outer drain opening 12 and inner drain opening 7. Thus, the corrosion of lower tube bundle 2B by the drain can be prevented.

Further, it is assumed that Titanium tubes are used for steam cooling tubes 15 in steam cooling tube bundle 2 (refer to FIG. 1). In this case, as steam cooling tubes 15 in steam cooling tube bundle 2 are not to be corroded by Ammonia, the drain of high Ammonia concentration condensed in air cooling tube bundle 4 is not required to be diluted. Accordingly, this embodiment is also effective in this case.

Further, in this embodiment, the drains condensed in upper tube bundle 2A (refer to FIG. 1) and air cooling tube bundle 4 are respectively guided to flow down into hot well 5 along tube support plate 9 from outer drain opening 12 and inner drain opening 7. Accordingly, in lower tube bundle 2B, the drop of the heat transfer on the tube bundle surfaces by the liquid film formed on tube surfaces can be prevented, thereby preventing the drop of thermal efficiency.

Third Embodiment

Next, a condenser according to a third embodiment of the present invention will be explained referring to FIG. 4. Further, this embodiment is partially modified from the second embodiment by adding the structure, and portions differing from the second embodiment will be explained below.

Figure 4:
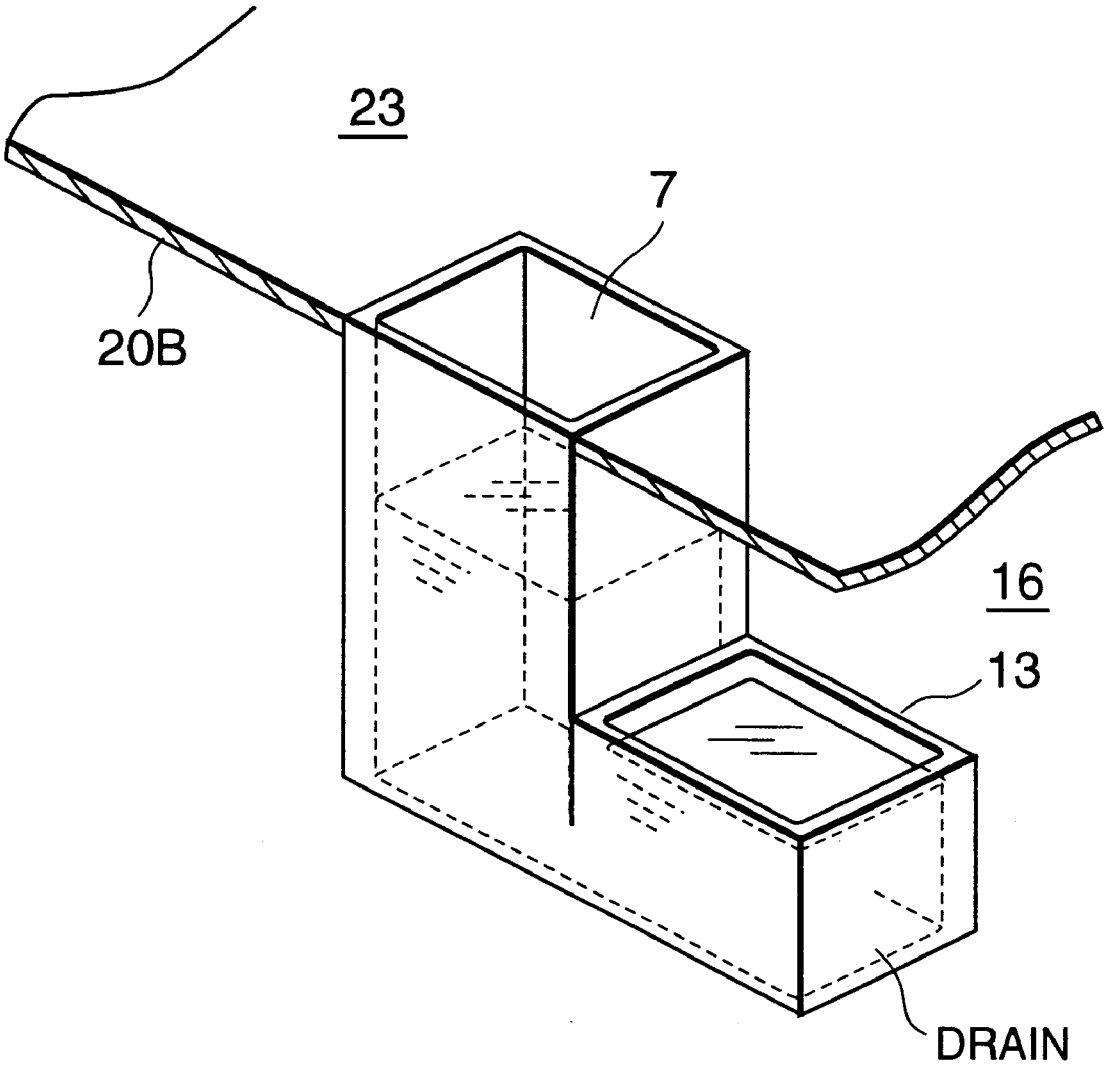
FIG. 4 is a perspective view showing an essential part of a condenser according to a third embodiment of the present invention.

FIG. 4 is a perspective view showing an essential part of a condenser according to this embodiment. In this embodiment, a drain discharge duct 13 made of a U-shaped duct is newly provided. As shown in FIG. 4, one end of drain discharge duct 13 is connected to inner drain opening 7 described in the second embodiment from its lower part, and the other end of drain discharge duct 13 opens upward toward the undersurface of bottom enclosing plate 20B. Further, as can be seen in FIG. 4, the outlet end of drain discharge duct 13 is lower than its inlet end connected to inner drain opening 7.

In the condenser according to this embodiment, the drain condensed in air cooling tube bundle 4 and accumulated in inner space 23 flows through drain discharge duct 13 and drops from the outlet thereof into hot well 5 (refer to FIG. 1).

As the drain flowed into drain discharge duct 13 made of the U-shaped duct is always accumulated therein, the counter flow of the steam into inner space 23 can be prevented, although the outlet end of drain discharge duct 13 is open in the air.

Fourth Embodiment

Next, a condenser according to a fourth embodiment of the present invention will be explained referring to FIG. 5. Further, this embodiment is modified from the first through third embodiments by partially adding the structure, and those portions differing from the first through third embodiments will be explained below.

Figure 5:
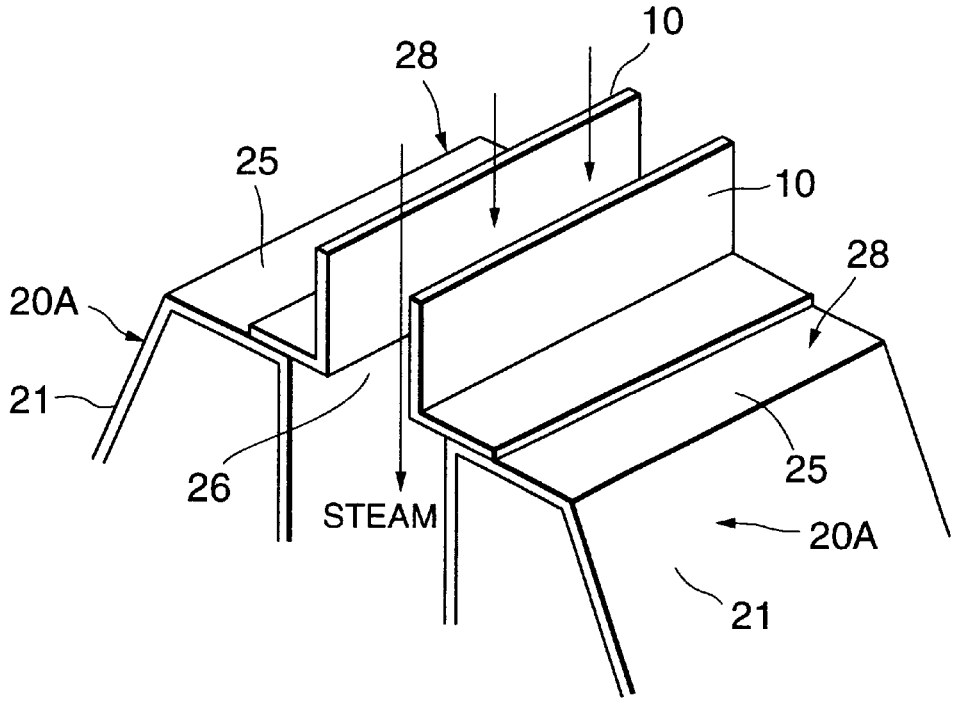
FIG. 5 is a perspective view showing an essential part of a condenser according to a fourth embodiment of the present invention.

FIG. 5 is a perspective view showing an essential part of a condenser according to this embodiment. A flat portion 25 is formed on the top of each of a pair of upper enclosing plates 20A. On a pair of flat portions 25, a pair of L-shaped steels 10 are disposed separately and facing each other along the extending direction of steam cooling tubes 15 (refer to FIG. 1). A distance between a pair of L-shaped steels 10 facing each other is set so as to optimize the volume of the steam flowing into the inside of enclosure 20 from upper tube bundle 2A.

The drain condensed in upper tube bundle 2A flows down along sloping surface 21 of upper enclosing plate 20A. On the other hand, the steam flowed through upper tube bundle 2A passes through a flowing space 26 put between a pair of L-shaped steels 10 and flows into the inside of enclosure 20.

As described above, according to the condenser of this embodiment, the volume of the steam flowing into the inside of enclosure 20 can be optimized by adjusting the distance between a pair of L-shaped steels 10 disposed on the upper end of a pair of upper enclosing plates 20A.

Further, the rigidity of the structure of enclosure 20 is improved by L-shaped steels 10 disposed on the tops of upper enclosing plate 20A.

Fifth Embodiment

Next, a condenser according to a fifth embodiment of the present invention will be explained referring to FIG. 6. Further, this embodiment is partially modified from the structure of the fourth embodiment, and those portions differing from the fourth embodiment will be explained below.

Figure 6:
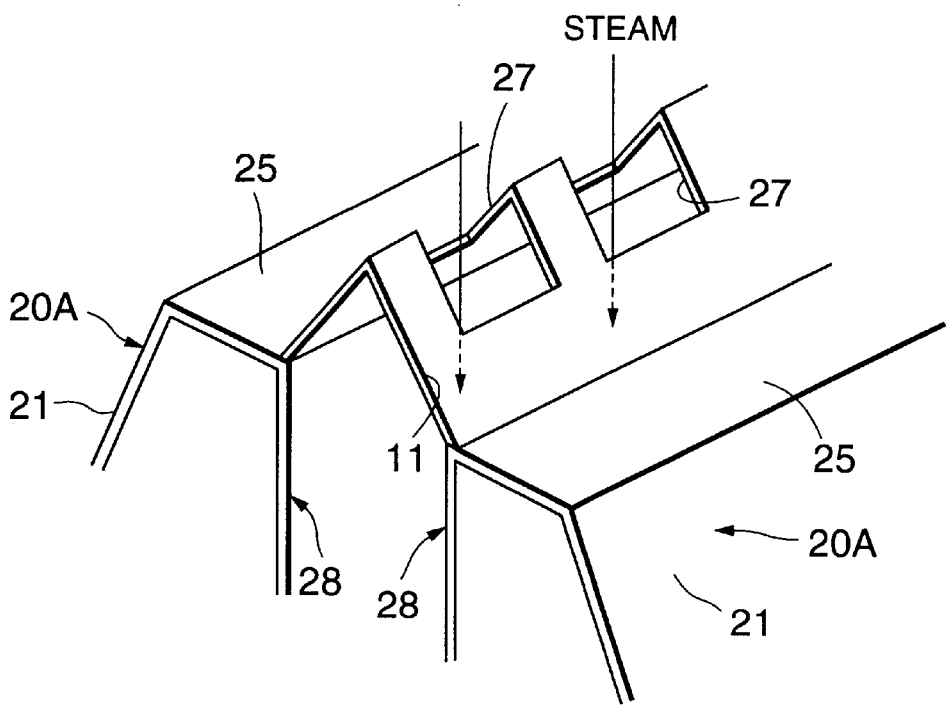
FIG. 6 is a perspective view showing an essential part of a condenser according to a fifth embodiment of the present invention.

FIG. 6 is a perspective view showing an essential part of a condenser according to this embodiment. In this embodiment, an L-shaped steel 11 is disposed instead of a pair of L-shaped steels 10 (refer to FIG. 5) in the fourth embodiment. Here, L-shaped steel 11 is disposed along the extending direction of steam cooling tubes 15 (refer to FIG. 1) in the upwardly convex state. Both side edges of L-shaped steel 11 are respectively connected to one ends of flat portions 25 of upper enclosing plate 20A. A number of steam flow-in openings 27 are formed on L-shaped steel 11 for leading the steam from upper tube bundle 2A into the inside of enclosure 20.

An opening area of steam flow-in openings 27 is set so as to optimize the volume of the steam flowing into the inside of enclosure 20 from upper tube bundle 2A.

The drain condensed in upper tube bundle 2A flows down along sloping surface 21 of upper enclosing plate 20A. On the other hand, the steam flowed through upper tube bundle 2A passes through steam flow-in openings 27 formed on L-shaped steel 11 and flows into the inside of enclosure 20.

As described above, according to the condenser of this embodiment, the volume of the steam flowing into the inside of enclosure 20 can be optimized by adjusting the opening area of steam flow-in openings 27 formed on L-shaped steel 11.

Further, the rigidity of the structure of enclosure 20 is improved by L-shaped steel 11 disposed on the tops of upper enclosing plate 20A.

As described above, according to the condenser of this invention, high corrosive drain condensed in the air cooling tube bundle flows down along the tube support plate after mixed and diluted with low corrosive drain condensed in the upper tube bundle. Accordingly, the corrosion of the lower tube bundle and the tube support plate by high corrosive drain can be prevented.

Further, according to the condenser of the present invention, the drains condensed in the upper tube bundle and the air cooling tube bundle flow down along the tube support plate from the outer drain opening and the inner drain opening, respectively. Accordingly, the corrosion of the lower tube bundle by the drain can be prevented.

Obviously, numerous modifications and variations of the present invention are possible in light of the above teachings. It is therefore to be understood that within the scope of the appended claims, the invention may be practiced otherwise than as specifically described herein.

What is claimed is:

1. A condenser, comprising:

a steam cooling tube bundle having a number of steam cooling tubes disposed in parallel with each other and extending horizontally;

an enclosure enclosing a central space formed at a center portion in a vertical direction at an inside of said steam cooling tube bundle;

an air cooling tube bundle disposed in said enclosure and having a number of air cooling tubes disposed in parallel with each other and extending along an extending direction of said steam cooling tube bundle; and a tube support plate supporting said steam cooling tube bundle;

said steam cooling tube bundle including an upper tube bundle positioned upward of said central space and a lower tube bundle positioned downward of said central space;

said enclosure including a pair of enclosing bodies disposed separately each other and symmetrically with respect to a vertical surface dividing said steam cooling tube bundle into two parts;

each of said enclosing bodies including an upper enclosing plate having at least a sloping surface inclined downward to an outside from an inside of said enclosure and a bottom enclosing plate disposed downward of said upper enclosing plate;

said bottom enclosing plate including an outermost end extending outside from an outermost end of said upper enclosing plate, and further including an outer dam part erected at said outermost end of said bottom enclosing plate;

said bottom enclosing plate including an innermost end extending inside from an innermost end of said upper enclosing plate, and further including an inner dam part erected at said innermost end of said bottom enclosing plate;

a lower end portion of said outermost end of said upper enclosing plate being joined to an upper surface of said bottom enclosing plate, thereby dividing an upper space of said upper enclosing plate into an inner space and an outer space;

a flow opening being formed at a joined portion of said upper enclosing plate and said bottom enclosing plate to communicate said inner space and said outer space; and a drain opening being formed at a joined portion of said bottom enclosing plate positioned at said inner space side and said tube support plate.

2. A condenser, comprising:

a steam cooling tube bundle having a number of steam cooling tubes disposed in parallel with each other and extending horizontally;

an enclosure enclosing a central space formed at a center portion in a vertical direction at an inside of said steam cooling tube bundle;

an air cooling tube bundle disposed in said enclosure and having a number of air cooling tubes disposed in parallel with each other and extending along an extending direction of said steam cooling tube bundle; and a tube support plate supporting said steam cooling tube bundle;

said steam cooling tube bundle including an upper tube bundle positioned upward of said central space and a lower tube bundle positioned downward of said central space;

said enclosure including a pair of enclosing bodies disposed separately each other and symmetrically with respect to a vertical surface dividing said steam cooling tube bundle into two parts;

each of said enclosing bodies including an upper enclosing plate having at least a sloping surface inclined downward to an outside from an inside of said enclosure and a bottom enclosing plate disposed downward of said upper enclosing plate;

said bottom enclosing plate including an outermost end extending outside from an outermost end of said upper enclosing plate, and further including an outer dam part erected at said outermost end of said bottom enclosing plate;

said bottom enclosing plate including an innermost end extending inside from an innermost end of said upper enclosing plate, and further including an inner dam part erected at said innermost end of said bottom enclosing plate;

a lower end portion of said outermost end of said upper enclosing plate being joined to an upper surface of said bottom enclosing plate, thereby dividing an upper space of said upper enclosing plate into an inner space and an outer space;

an outer drain opening being formed at a joined portion of said bottom enclosing plate positioned at said outer space side and said tube support plate; and an inner drain opening being formed at a joined portion of said bottom enclosing plate positioned at said inner space side and said tube support plate.

3. The condenser according to claim 2, wherein:

each of said enclosing bodies further includes a U-shaped duct, one end of which is connected to said inner drain opening from its lower side, and another end of which opens toward an undersurface of said bottom enclosing plate.

4. The condenser according to one of claims 1 to 3, wherein:

said enclosure further includes a pair of L-shaped steels disposed separately and facing each other on upper ends of a pair of said upper enclosing plates along an extending direction of said steam cooling tubes, respectively, and a distance between a pair of said L-shaped steels is set so as to optimize a volume of a steam flowing into said enclosure from said upper tube bundle.

5. The condenser according to one of claims 1 to 3, wherein:

said enclosure further includes an L-shaped steel disposed along an extending direction of said steam cooling tubes, both side edges of said L-shaped steels are connected respectively to upper ends of a pair of said upper enclosing plates, and a steam flow-in opening is formed on said L-shaped steel so as to optimize a volume of a steam flowing into said enclosure from said upper tube bundle.

* * * * *